US006170164B1

(12) United States Patent
Knowles

(10) Patent No.: US 6,170,164 B1
(45) Date of Patent: Jan. 9, 2001

(54) WINGED PEEP SIGHT

(76) Inventor: Richard E. Knowles, P.O. Box 152, Locust Grove, OK (US) 74352

( * ) Notice: Under 35 U.S.C. 154(b), the term of this patent shall be extended for 0 days.

(21) Appl. No.: 09/292,148

(22) Filed: Apr. 15, 1999

(51) Int. Cl.[7] ..... F41G 1/467
(52) U.S. Cl. ..... 33/265; 124/87
(58) Field of Search ..... 33/265, 246, 251; 124/87

(56) References Cited

U.S. PATENT DOCUMENTS

| | | | | |
|---|---|---|---|---|
| 2,351,103 | * | 6/1944 | Brown | 33/265 |
| 3,859,733 | | 1/1975 | Chesnick | 33/265 |
| 3,997,974 | * | 12/1976 | Larson | 33/265 |
| 4,656,746 | | 4/1987 | Gillespie | 33/265 |
| 4,656,747 | | 4/1987 | Troncoso | 33/265 |
| 5,107,596 | | 4/1992 | Snyder | 33/265 |
| 5,303,479 | | 4/1994 | Rudovsky | 33/265 |
| 5,325,598 | * | 7/1994 | Hall et al. | 33/265 |
| 5,379,748 | | 1/1995 | Carlson | 124/87 |
| 5,542,186 | | 8/1996 | Saunders | 33/265 |
| 5,669,146 | * | 9/1997 | Beutler | 33/265 |
| 5,697,357 | * | 12/1997 | Chipman | 33/265 |
| 5,762,059 | | 6/1998 | Strope | 124/87 |

* cited by examiner

*Primary Examiner*—Christopher W. Fulton
(74) *Attorney, Agent, or Firm*—Molly D. McKay

(57) ABSTRACT

The present invention is a winged peep sight that attaches to a bowstring of an archery bow. The winged peep sight is provided with an oval base having a perimeter groove that is served between the strands of the bowstring. A proximal end of a horizontal wing adjustably secures to the base by means of a retaining bracket and adjustable screw provided on the base. The peep sight body has a hollow front half that removably engages a hollow back half to allow the halves to be separated. When separated, one of a variety of interchangeable inserts between the halves. Each insert is provided with one or more notches in its perimeter that insert around one or more ears provided in the back half.

11 Claims, 4 Drawing Sheets

WINGED PEEP SIGHT

BACKGROUND OF THE INVENTION

1. Field of the Invention

The present invention relates to a winged peep sight for attachment to a bowstring of an archery bow. The present invention includes an oval base that is served into the bowstring and a horizontally adjustable wing that extends horizontally outward to one side of the base. A peep sight body is provided at the distal end of the adjustable wing, allowing the user to adjust the peep sight body horizontally to suit the user. The peep sight body is also provided with a removable front half that allows the user to replace the insert located within the peep sight body with a variety of different interchangeable inserts, further allowing the peep sight body to be customized for the user.

2. Description of the Related Art

Peep sights are used in association with archery bows to allow the archer to look through the peep sight body and thereby achieve better aim with an arrow when shooting with the bow. Some peep sights mount directly to the bow and others mount on the bowstring. Of those that mount on the bowstring, almost all of them are sewn or served between the strands of the bowstring. Most such bowstring mounting peep sights have the peep sight body located between the strands of the bowstring or very near to the bowstring. There are several problems with these types of bowstring mounting peep sights.

First, in order to use these bowstring mounting bow sights, the archer's eye must be placed very near to the bowstring. This can be a safety hazard since the archer's eye can easily encounter the bowstring as the arrow is launched, resulting in a bad burn or abrasion to the eye.

Second, since these bowstring mounting peep sights are located approximately in line with the bowstring, this makes it awkward for the archer to bend his head to the side so that his eye aligns with the opening in the peep site while he is shooting an arrow.

Finally, these currently available bowstring mounting peep sights generally have a fixed peep opening and do not allow the user to select an insert having a peep sight opening to his liking.

The present invention addresses these problems by providing a winged peep sight that attaches to the bowstring with a base and has a horizontal wing adjustably attached to the base. A peep sight body is provided at the distal end of the horizontal wing so that the archer can adjust the horizontal location of the peep sight body in order to place the peep sight body further away from the bowstring and in more comfortable alignment with the archer's head. The peep sight body of the present invention is comprised of three parts: a front half, a back half and an insert. The front half is removable from the back half and a variety of interchangeable inserts that can be placed between the front and back halves of the peep sight body, allowing the archer to select a peep sight opening that is to his liking.

SUMMARY OF THE INVENTION

The present invention is a winged peep sight that attaches to a bowstring of an archery bow. The winged peep sight is provided with a base that attaches to the bowstring by employing string to sew or serve the base between strands of the bowstring. The base is preferably oval and is provided with a groove along its perimeter, which receives the strands of the bowstring therein and helps to keep the base tightly secured to the bowstring when served thereto.

A front surface of the base is provided with a retaining bracket with an adjustable screw for adjustably holding a proximal end of a horizontal wing to the base. A peep sight body is provided at the opposite distal end of the horizontal wing so that the archer can adjust the horizontal location of the peep sight body in order to place the peep sight body further away from the bowstring and in more comfortable alignment for the archer. The distal end of the horizontal wing is preferably twisted slightly longitudinally so that, when the bowstring is pulled back in order to aim the arrow, the horizontal wing holds the peep sight body so that the peep sight body is approximately level from its front to its back.

The peep sight body of the present invention is comprised of three parts: a front half, a back half and an insert. The front half is provided with a central opening extending therethrough and the back half is also provided with a central opening extending therethrough. The front half is provided with male threads that removably engage female threads provided on the back half in order to form a space between the halves when they are engaged together. One of several different types of interchangeable inserts is placed in the space between the halves to customize the peep sight body for the archer. Some archers prefer using an insert with a small hole, some prefer an insert with a larger hole, some prefer an insert with cross hairs, and some prefer a blank or clear insert. Each insert is provided with one or more notches in its perimeter that insert around one or more ears provided in the back half at the space between the front and back halves as a means to prevent the insert from rotating within the peep sight body.

DETAILED DESCRIPTION OF THE PREFERRED EMBODIMENT

Winged Peep Sight

Figure 1:
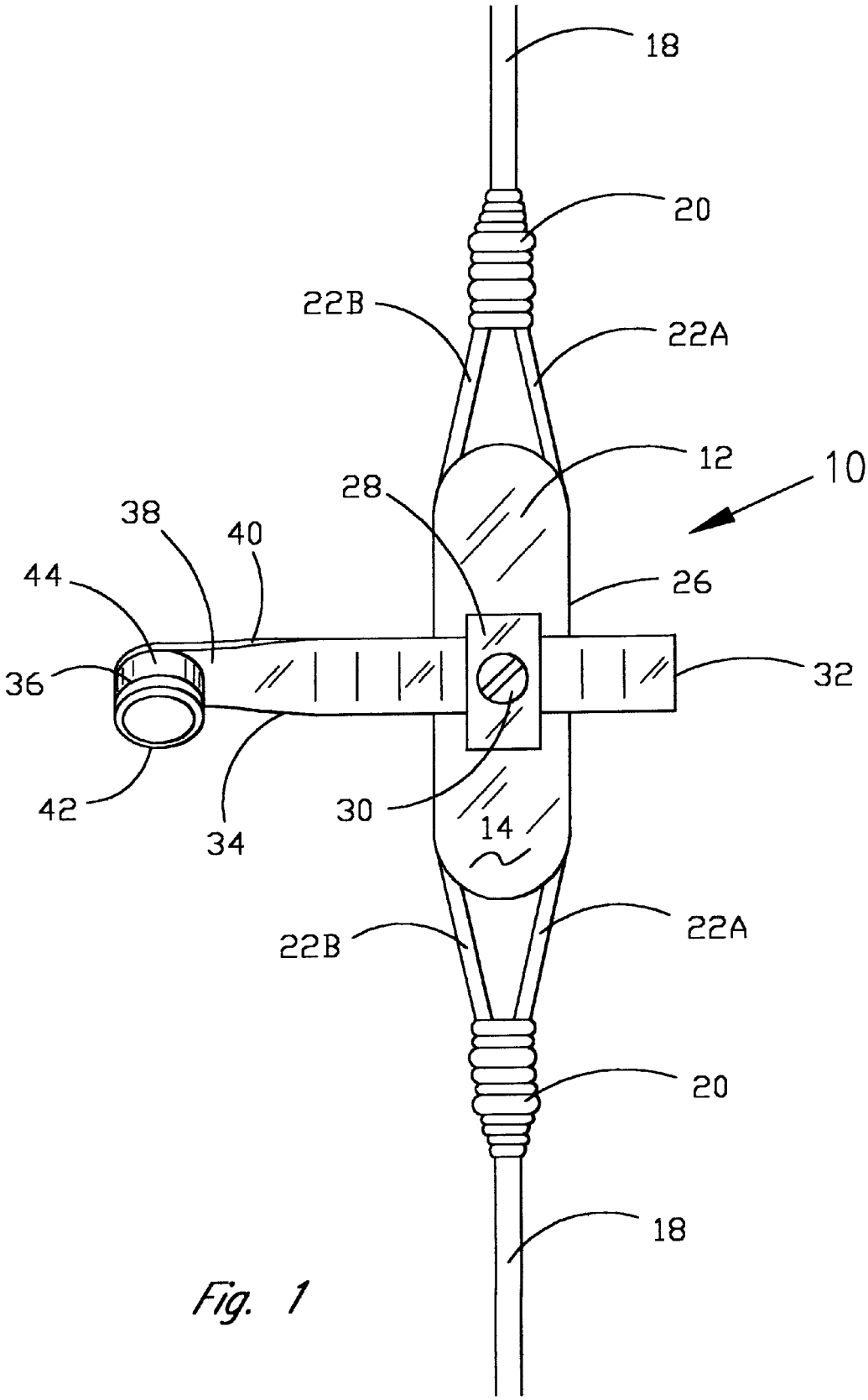
FIG. 1 is a front elevation of a winged peep sight constructed in accordance with a preferred embodiment of the present invention, shown attached to a bowstring.

Referring now to the drawings and initially to FIG. 1, there is illustrated a winged peep sight 10 constructed in accordance with a preferred embodiment of the present invention. The winged peep sight 10 is provided with a base 12 that is preferably flat on its front and rear surfaces 14 and 16. The base 12 attaches to a bowstring 18 of an archery bow (not illustrated). The winged peep sight 10 attaches to the bowstring 18 by employing string 20 to sew or serve the base 12 between individual strands 22A and 22B of the bowstring 18.

Figure 5:
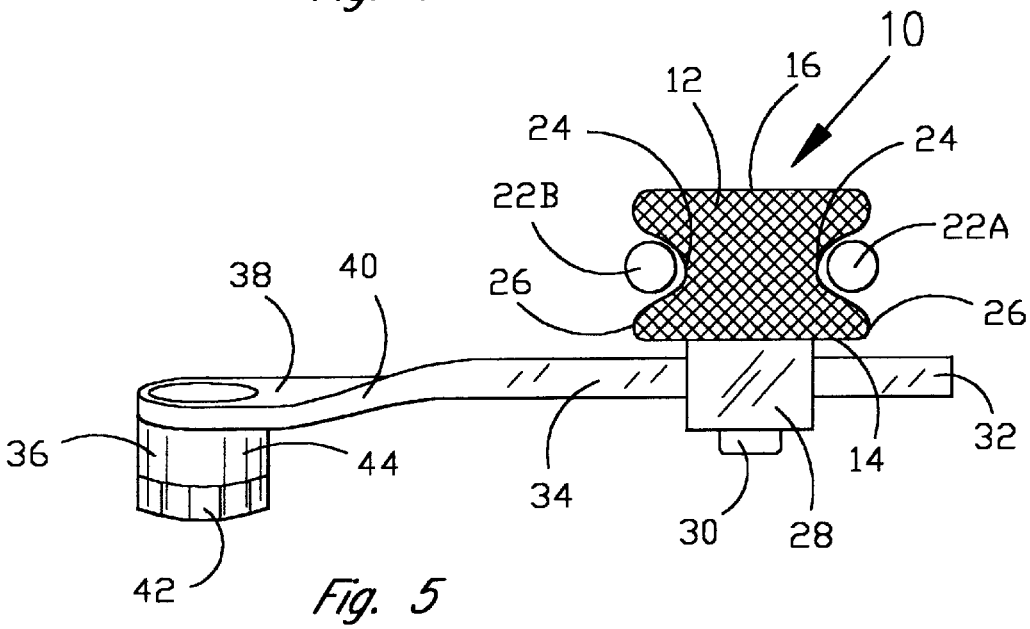
FIG. 5 is a cross sectional view taken along line 5—5 of FIG. 4.

Also referring now to FIG. 5, the base 12 is preferably an elongated oval shape. The base 12 is provided with a groove 24 along its perimeter 26 that receives the strands 22A and 22B of the bowstring 18 therein and helps to keep the base 12 tightly secured to the bowstring 18 when served thereto.

Figure 4:
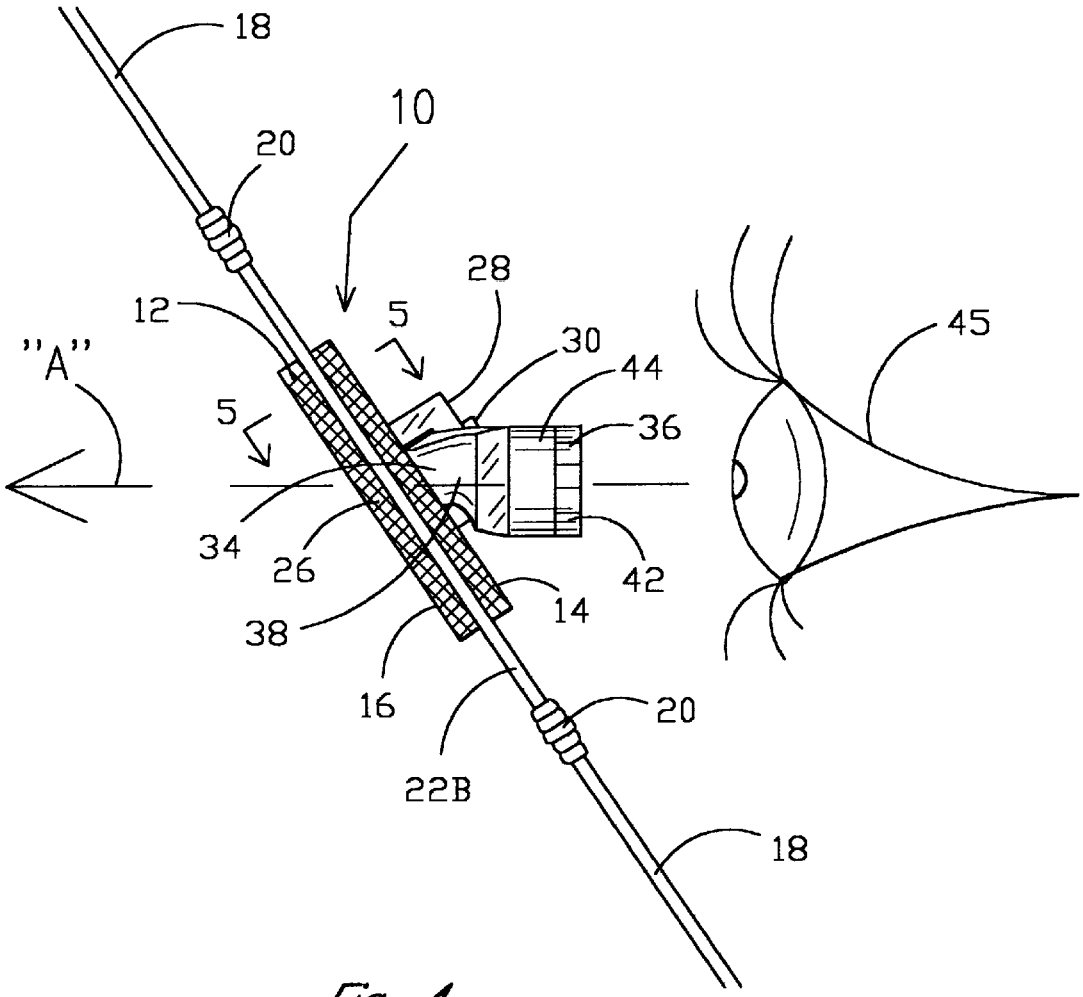
FIG. 4 is a left side elevation of the winged peep sight of FIG. 1, as it would appear when the bowstring is drawn and the peep sight body is brought near to an eye of an archer.

The front surface 14 of the base 12 is provided with a retaining bracket 28 with an adjustable screw 30 for adjustably holding a proximal end 32 of a horizontal wing 34 to the base 12. A peep sight body 36 is provided attached at an opposite distal end 38 of the horizontal wing 34 so that an archer can adjust the peep sight body 36 horizontally in order to place the peep sight body 36 further away from the bowstring 18 and in more comfortable alignment for the archer. As best illustrated in FIGS. 1 and 5, the distal end 38 of the horizontal wing 34 is preferably provided with a slight longitudinal twist 40. The twist 40 allows the horizontal wing 34 to hold the peep sight body 36 approximately level from its front half 42 to its back half 44, as shown in FIG. 4, when the bowstring 18 is pulled back toward an archer's eye 45 in order to aim an arrow (not illustrated).

Figure 2:
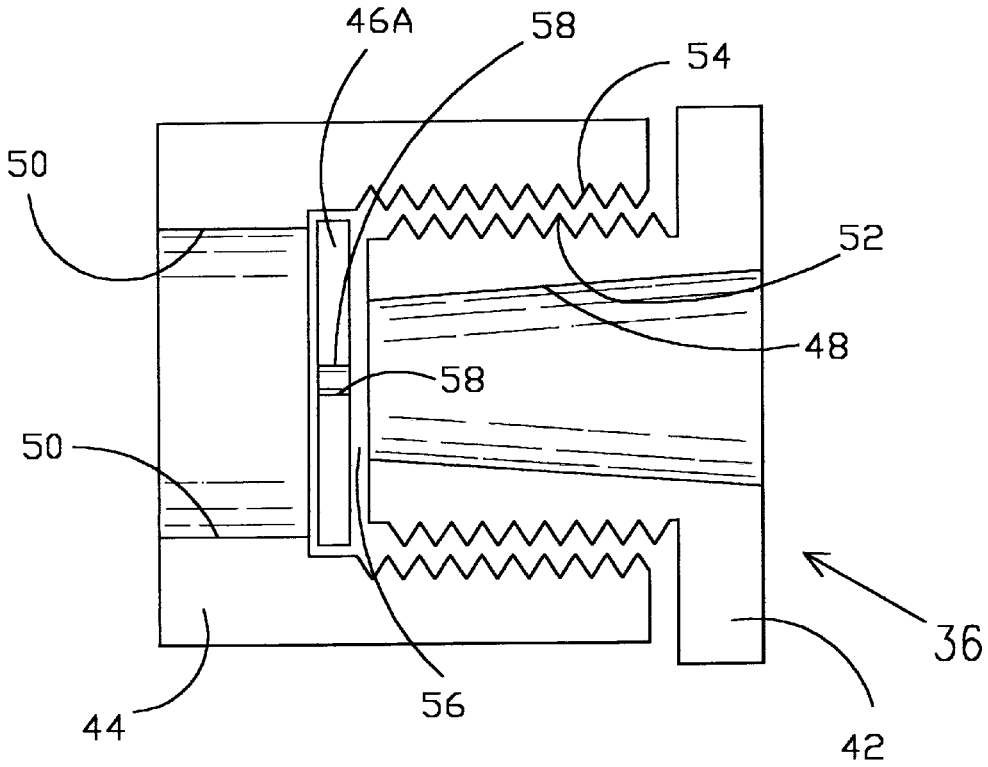
FIG. 2 is an enlarged cross sectional view of the peep sight body of the winged peep sight of FIG. 1.
Figure 3:
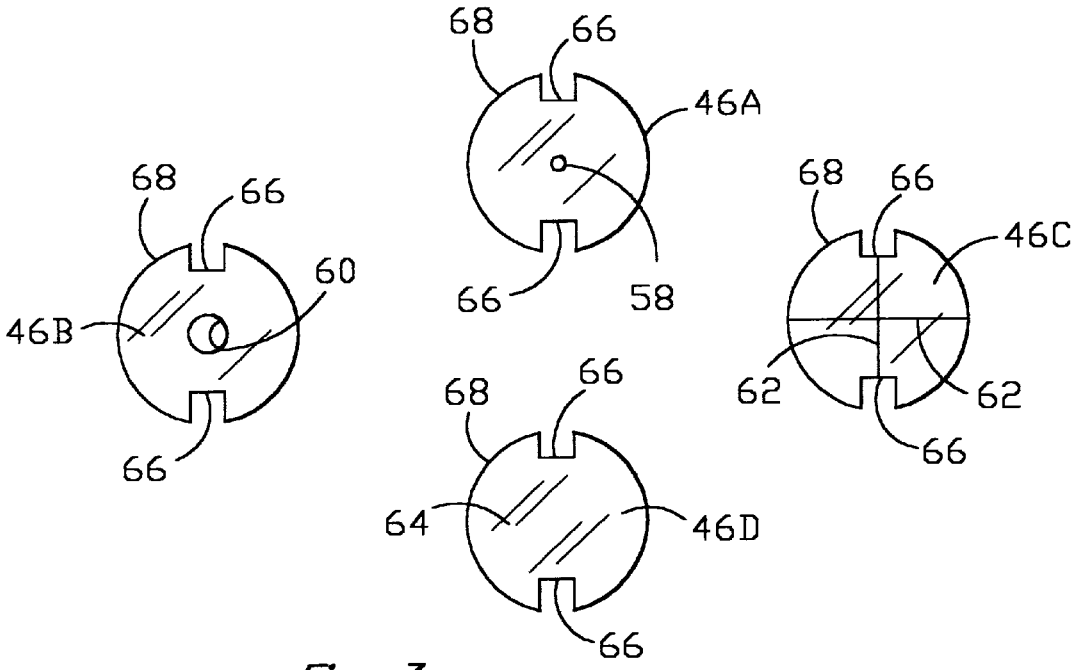
FIG. 3 is a front elevation of a variety of interchangeable inserts for use in the peep sight body of FIG. 2.

Referring now to FIGS. 2 and.3, the peep sight body 36 of the present invention is comprised of three parts: the front half 42, the back half 44 and an interchangeable insert 46A, 46B, 46C, or 46D. The front half 42 is provided with a central opening 48 extending through the front half 42, and the back half 44 is also provided with a central opening 50 extending through the back half 44. The front half 42 is provided with male threads 52 that removably engage female threads 54 provided on the back half 44 in order to removably secure the front and back halves 42 and 44 together. When the front and back halves 42 and 44 are secured together, a space 56 is formed between the halves 42 and 44. One of the interchangeable inserts 46A, 46B, 46C, or 46D is placed in the space 56 between the halves 42 and 44 to customize the peep sight body 36 for the archer. Some archers prefer using an insert 46A with a small hole 58, some prefer an insert 46B with a larger hole 60, some prefer an insert 46C with cross hairs 62, and some prefer a blank area 64 in a clear insert 46D.

Figure 6:
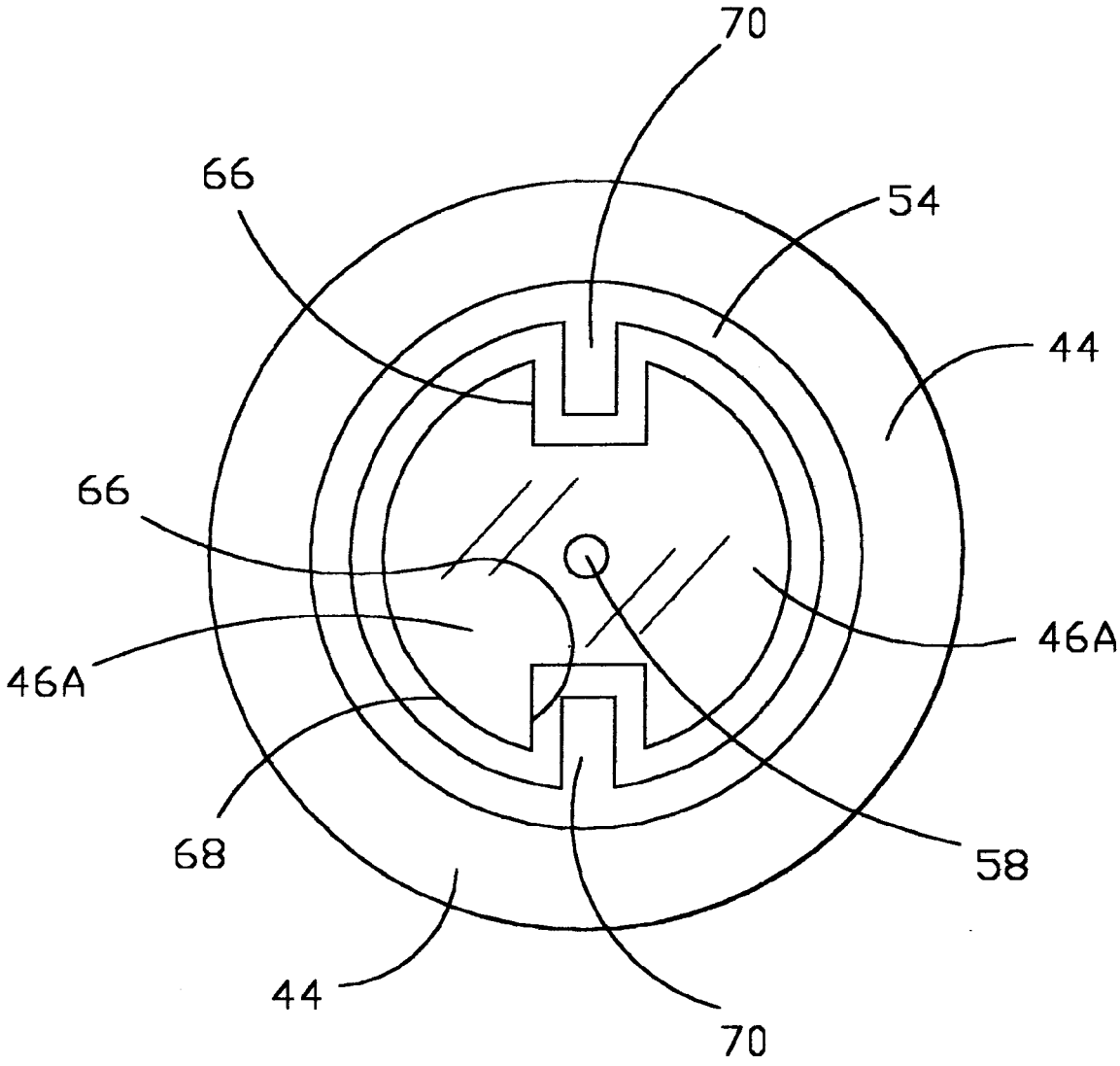
FIG. 6 is a front elevation of the peep sight body of FIG. 2, with the front half removed to show an insert within the back half of the peep sight body.

Referring also to FIG. 6, each insert 46A, 46B, 46C, and 46D is provided with one or more notches 66 in its perimeter 68. The notch or notches 66 insert around one or more ears 70 provided in the back half 44 so that the ears extend into the space 56 between the front and back halves 42 and 44 as a means to prevent the insert 46A, 46B, 46C, or 46D from rotating within the peep sight body 36.

Although the wing 34 has been described as including the longitudinal twist 40 in order that the peep sight body 36 will be approximately level when the bowstring 18 is drawn, the winged peep sight 10 may be constructed without the twist 40. When the twist 40 is not employed, the bore through the peep sight body 36 should be tilted to maintain a visual path, as illustrated by arrow A in FIG. 4, through the peep sight body 36 along a horizontal axis. That means that when the twist 40 is omitted, the central openings 48 and 50 in the front and back halves 42 and 44, respectively, must be tilted so that the openings 48 and 50 are approximately horizontal when the bowstring 18 is drawn.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A winged peep sight for attachment to a bowstring of an archery bow comprising an elongated base secured between strands of a bowstring on an archery bow, a wing adjustably secured to said elongated base so said wing adjusts horizontally relative to said base, and a peep sight body secured on a distal end of said wing.

2. A winged peep sight according to claim 1 wherein said peep sight body further comprises a back half secured to said distal end of said wing, a front half removably engaging with said back half, and a replaceable insert removably secured between said front half and said back half.

3. A winged peep sight according to claim 2 further comprising said back half provided with a central opening extending through it, and said front half provided with a central opening extending through it.

4. A winged peep sight according to claim 3 further comprising a retaining bracket provided on said elongated base, an adjustable screw extending through said retaining bracket as a means for adjustably securing said wing to said elongated base.

5. A winged peep sight according to claim 4 further comprising a slight longitudinal twist provided in said horizontal wing so that said peep sight body is approximately horizontal when said bowstring is drawn.

6. A winged peep sight according to claim 5 further comprising ears provided internally within the back half for removably receiving notches in a perimeter of said replaceable insert.

7. A winged peep sight according to claim 3 further comprising male threads provided on said front half of said peep sight body and female threads provided on said back half of said peep sight body as a means for the front and back halves to removably engage each other.

8. A winged peep sight according to claim 2 wherein said replaceable insert is provided with a hole extending through said insert.

9. A winged peep sight according to claim 2 wherein said replaceable insert is provided with cross hairs.

10. A winged peep sight according to claim 2 wherein said replaceable insert is clear.

11. A winged peep sight according to claim 1 further comprising a groove provided in a perimeter of said elongated base for receiving said strands of said bowstring.

* * * * *